United States Patent [19]

Yanagisawa et al.

[11] 3,945,428

[45] Mar. 23, 1976

[54] DIE ASSEMBLY FOR SQUEEZE CASTING OF METALS

[75] Inventors: Ikuo Yanagisawa, Shizuoka; Toshiyuki Kawai, Shimizu, both of Japan

[73] Assignee: Nippon Light Metal Research Laboratory Ltd., Tokyo, Japan

[22] Filed: June 24, 1974

[21] Appl. No.: 482,561

[52] U.S. Cl. ..... 164/319; 249/160

[51] Int. Cl.[2] ..... B22D 17/12; B41B 11/54

[58] Field of Search ..... 164/319, 113, 120, 321, 164/320, 203, 342, 327; 249/164; 249/160, 161, 162, 163, 164

[56] References Cited

UNITED STATES PATENTS

| | | | |
|---|---|---|---|
| 2,254,295 | 9/1941 | Kohl | 249/162 X |
| 2,442,516 | 6/1948 | Shriver | 164/342 X |
| 2,521,520 | 9/1950 | Jancura | 164/342 X |
| 3,068,539 | 12/1962 | Wilcoxon | 164/320 |
| 3,767,168 | 10/1973 | Dupre | 164/203 X |

*Primary Examiner*—Francis S. Husar
*Assistant Examiner*—John S. Brown
*Attorney, Agent, or Firm*—William J. Daniel

[57] ABSTRACT

A die assembly for squeeze casting of metals wherein a tubular reinforcing die is set on a base, a forming die consists of split dies is inserted in internal contact with the reinforcing die and the surface in internal contact with the reinforcing die is tapered so as to be narrower downward so that, in case a downward force is applied by a sealing die to a molten metal poured into the forming die, the split dies may be pushed in downward along the tapered surface to prevent the molten metal from spitting out.

5 Claims, 3 Drawing Figures

DIE ASSEMBLY FOR SQUEEZE CASTING OF METALS

This invention relates to improvements in a die assembly to be used in a squeeze casting apparatus of such system of obtaining a cast metal by applying pressure to a molten metal poured into a cavity of forming die during its solidification proceeds.

In a conventional squeeze casting apparatus of this kind, a forming die is set on a base, a sealing die operated by a piston or the like is lowered from an opening above the forming die so that a molten metal poured into the forming die may be sealed in the forming die and then a pressing die provided in the bottom part of the forming die is elevated or relatively elevated so that the sealed molten metal may be solidified under pressure.

Some occasion, a sealing die has a inner piston and pressure is applied by the movement of inner piston of the sealing die.

In the forming die, as split dies are usually used so that the cast metal may be easily taken out, the split dies must be held tightly enough against the internal pressure in the case of applying pressure to the molten metal so that the danger of the molten metal spitting out through the jointing parts may be avoided, a strong fastening mechanism must be provided around the forming die so that the applied pressure may act effectively enough and therefore not only the apparatus is complicated but also the casting operation is complicated requires troubles.

(Refer, for example, to pages 486 to 492 of the Journal of Japan Society for Technology of Plasticity, Vol. 8, No. 80 (Sept. 1967).)

An object of the present invention is to provide a a die assembly wherein the above mentioned defects in the conventional squeeze casting apparatus are eliminated and a safe and efficient casting operation can be made.

In a die assembly of the present invention, a tubular reinforcing die is provided on a base on which a forming die is to be set, the forming die is inserted in internal contact with the reinforcing die and the internal contact surface is tapered so as to be narrower downward.

Figure 1:
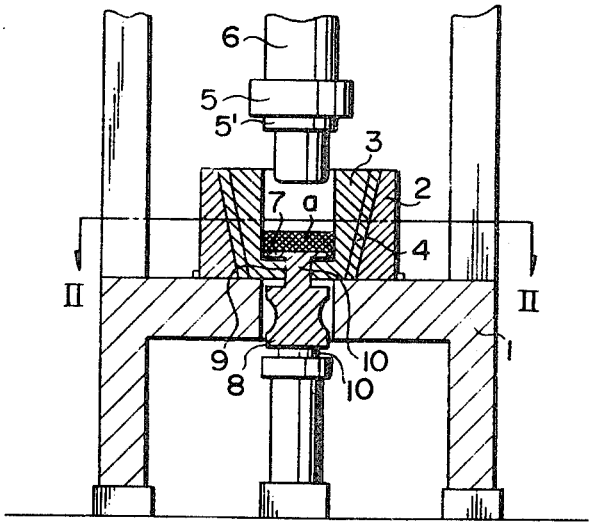
FIG. 1 is a sectional view showing a die assembly embodying the present invention.
Figure 2:
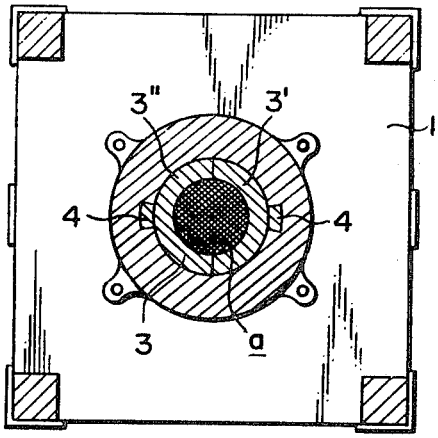
FIG. 2 is a sectional view on line II — II in FIG. 1.

In FIGS. 1 and 2, 1 is a base on which a die assembly is to be set, 2 is a metalic tubular reinforcing die fixed with a proper fixture on the base 1 and tapered on the inside surface so that the inside diameter may be smaller downward, 3 is a metalic forming die having such outside contour as can be inserted in internal contact with the reinforcing die 2 and formed of split dies 3′ and 3″ splittable into a plurality in the horizontal direction, 4 is a wedge-shaped concave and convex fitting part provided in the vertical direction on the contact surfaces of both dies 2 and 3 so that the forming die 3 may be correctly inserted and moved up and down along the surface of contact with the reinforcing die 2, and 5 is a sealing die fitted near the lower end of a piston 6 operated by a proper apparatus for applying such pressure as an oil pressure or hydraulic pressure and provided below it with a projecting part 5′ to be inserted into the forming die 3 so as to form the inside surface part of the die in case the sealing die 5 is pressed in contact with the upper surface of the forming die 3.

The jointing surfaces of the sealing die 5 and forming die 3 with each other are so formed that a molten metal a poured into the forming die 3 may be perfectly sealed when they are pressed into contact with each other.

Further, 7 is a metalic pressing die fitted to the upper end part of a piston 10 liquid-tightly vertically passing through a through hole 9 made in the bottom part of the forming die 3 so as to slide vertically along the inside wall surface of the forming die 3 when the piston 10 is operated. A flange 8 is provided in the intermediate part of the piston 10 so that, after the completion of the casting, when the piston 10 is further elevated, the forming die 3 may be pushed up in the bottom part by the flange 8 and it may be casy to take out the cast metal and the clean the die.

Figure 3:
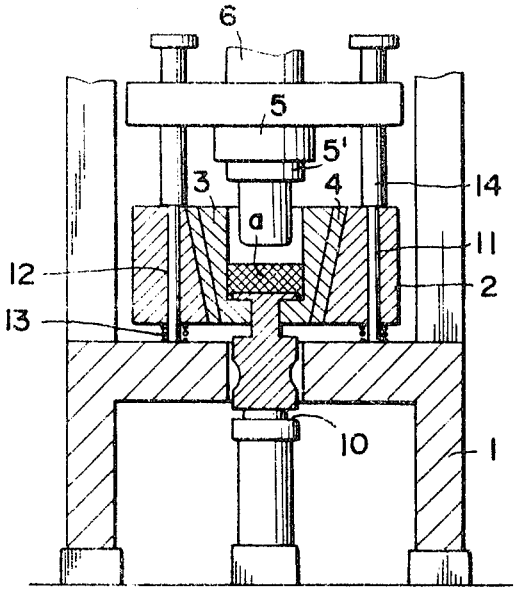
FIG. 3 is a sectional side view, similar to FIG. 1, showing a second embodiment of the present invention.

The embodiment shown in FIG. 3 is almost similar to that shown in FIG. 1 in the construction except the reinforcing die 2 which is not fixed directly to the base 1. In FIG. 3, the reinforcing die 2 is carried by upright supporting posts 11 mounted on the base 1. In other words, the reinforcing die is provided with at least two holes 12 passing vertically therethrough, each of the holes of which receiving fittably each of the upright supporting posts 11. A spring means 13 is interposed between the upper surface of the base 1 and the lower surface of the reinforcing die 2. The upper part of the supporting post 12 is formed with a larger diameter portion 14 which prevent the reinforcing die 2 from slipping out upwardly of the supporting post 11. The spring means 13 serves to absorb the shock applied to the dies 2 and 3 by descending movement of the sealing die 5. The descending movement of the sealing die 5 causes the forming die 3 to be descended. In this case the molten metal in the forming die 3 is urged against the sealing die 5, by the action of the spring means 13.

In the die assembly of the present invention, as mentioned above, the forming die 3 is inserted in internal contact with the inside surface of the tubular reinforcing die 2 set on the base 1 and its contact surface is tapered so as to be narrower downward, therefore, when a molten metal is to be cast under pressure, in case the sealing die 5 is pressed in contact with the upper surface of the forming die 3 to seal the molten metal, the split dies 3′ and 3″ consisting the forming die 3 will be so strongly pushed in downward along the tapered internal contact surface of the reinforcing die by the downward force applied to the upper surface of the forming die 3 by the sealing die 5 that the die will be fastened tightly enough, the contact on the internal contact surface with the reinforcing die 2 will be more intimate, thus the molten metal will be perfectly prevented from spilling out through the jointing parts of the split dies 3′ and 3″ and the pressure applied to the molten metal will be able to act on the molten metal effectively enough.

Further, when the piston 10 is elevated, the split dies 3′ and 3″ will open outward along the tapered surface and therefore the casting product will be able to be easily taken out.

As described above, according to the die assembly of the present invention, the forming die can be fastened tightly enough for casting under pressure without providing a mechanism for fastening the forming die as in a squeeze casting apparatus in which a forming die formed of conventional split molds is used, therefore the apparatus is simplified and the casting operation can be made very easy and efficient.

We claim:

1. In a squeeze casting apparatus for metals wherein a molten metal is poured into a forming die provided on a base, the die is sealed, and the metal is solidified while pressure is applied thereto in a generally vertical direction, the improvement wherein said forming die is a die assembly comprising a tubular reinforcing metal mold set on a base said tubular reinforcing mold having a downwardly tapering inner bore; and a forming die disposed within the bore of said mold and having its exterior surfaces extending in mating tapering relation to said tapered bore wall, said forming die being formed of at least two sections joined together along generally vertical abutting surfaces and defining therewithin a die cavity for said molten metal, whereby said mating tapering surfaces on said mold and die act in response to said applied pressure to urge said die forming sections into intimate contact to prevent metal spillage between said die sections.

2. A die assembly according to claim 1 wherein said forming die consists of at least two split dies.

3. A die assembly according to claim 2 wherein wedge-shaped concave and convex fitting parts are provided in the vertical direction on the internal contact surfaces of said tubler reinforcing die and forming die.

4. A die assembly according to claim 1 wherein a mechanism for pushing up the forming die is further provided and comprises a piston moving up and down through a through hole made in the bottom part of the forming die and a flange provided in the intermediate part of said piston.

5. A die assembly according claim 1, which comprises upright supporting posts mounted on said base, holes formed in said reinforcing die so as to pass said upright supporting posts therethrough and spring means interposed between said base and said reinforcing die, said upright supporting posts being of increased diameter adjacent the upper ends thereof.

* * * * *